US005907218A

United States Patent [19]

Altman et al.

[11] Patent Number: 5,907,218

[45] Date of Patent: May 25, 1999

[54] FLUORESCENT LIGHTING ASSEMBLY WITH INTEGRAL BALLAST

[75] Inventors: Barry Eddington Altman, Mechanicsburg, Pa.; John Francis Turner, Jr., Clemmons; Albert David Willette, Winston-Salem, both of N.C.

[73] Assignee: The Whitaker Corporation, Wilmington, Del.

[21] Appl. No.: 08/967,534

[22] Filed: Nov. 10, 1997

Related U.S. Application Data

[ 60] Provisional application No. 60/034,643, Jan. 6, 1997, and provisional application No. 60/033,274, Dec. 9, 1997.

[51] Int. Cl.[6] ..... H01J 7/44

[52] U.S. Cl. ..... 315/56; 315/209 R; 315/DIG. 1; 362/221; 439/235

[58] Field of Search ..... 315/56, 58, 209 R, 315/DIG. 1, 324; 362/220, 221, 225, 260, 265; 439/56, 235, 237

[56] References Cited

U.S. PATENT DOCUMENTS

| | | | |
|---|---|---|---|
| 2,923,856 | 2/1960 | Greene et al. | 315/138 |
| 3,593,060 | 7/1971 | Kryder | 315/219 |
| 4,504,891 | 3/1985 | Mazis | 362/219 |
| 4,538,095 | 8/1985 | Nilssen | 315/244 |
| 4,562,381 | 12/1985 | Hammer et al. | 315/99 |
| 4,794,271 | 12/1988 | McNair | 307/38 |
| 4,862,035 | 8/1989 | Cunliffe et al. | 315/58 |
| 4,972,124 | 11/1990 | Powers | 315/219 |
| 4,973,886 | 11/1990 | Hasson et al. | 315/324 |
| 4,978,319 | 12/1990 | Freed | 439/638 |
| 5,008,790 | 4/1991 | Fabbri | 362/220 |
| 5,013,253 | 5/1991 | Aiello et al. | 439/235 |
| 5,138,528 | 8/1992 | Altman et al. | 361/400 |
| 5,150,014 | 9/1992 | Kastelein | 315/224 |
| 5,247,228 | 9/1993 | Roche | 315/53 |
| 5,434,481 | 7/1995 | Nilssen | 315/247 |
| 5,438,243 | 8/1995 | Kong | 315/219 |
| 5,486,121 | 1/1996 | Miller | 439/652 |
| 5,550,436 | 8/1996 | Houk | 315/209 R |
| 5,558,420 | 9/1996 | Oki et al. | 362/31 |
| 5,568,018 | 10/1996 | Muzic | 315/276 |
| 5,588,740 | 12/1996 | Kasuga | 362/221 |
| 5,720,546 | 2/1998 | Correll, Jr. et al. | 362/221 |
| 5,727,871 | 3/1998 | Kotloff | 362/225 |

FOREIGN PATENT DOCUMENTS 2646621 4/1978 Germany .

OTHER PUBLICATIONS

International Rectifier, Control Integrated Circuit Designers' Manual, pp. 188 through 192 noted.

SGS—Thomson Microelectrics—Application Note—Designing a High Power Factor Switching Preregulator with the L6560/A Transition Mode I.C., by G. Comandatore and U. Moriconi; AN667/0795, 1994.

Telcol Technical Bulletin 105 "The Electronic Ballast That Meets Your Fluorescent Lighting Needs" noted.

*Primary Examiner*—Don Wong
*Assistant Examiner*—Haissa Philogene

[57] ABSTRACT

A lighting assembly 2 includes a ballast subassembly 4, fluorescent lamps 30 and connectors 50 for connecting the ends of two lamps forming an associated pair. The ballast subassembly 4 is connected to only one base of two lamps and the other ends are connected by commoning socket connectors 50 that are not attached to the ballast subassembly 4. The ballast subassembly 4 includes a power supply circuit 100 and a ballast circuit 102 that can energize two fluorescent lamps 30 with remote lamp bases 34 commoned. The ballast subassembly 4 is mounted on one end of the lighting subassembly, for example on one end of a troffer 80. No wires or other direct electrical connection are necessary with the other end of the lighting assembly 4, the lamps 30, or the troffer 80. The commoning connectors 50 can employ bus contacts 64 having integral cantilever terminals 74 extending from a central bus section 66. These contacts can be mounted in socket housings 52 for connecting two side by side instant start fluorescent lamps.

20 Claims, 10 Drawing Sheets

16
8
6
14
14
20
20
18
22
22
14
20
20
8
16
4
20
22
22
22
12
12
12
12
10
10

FLUORESCENT LIGHTING ASSEMBLY WITH INTEGRAL BALLAST

This application claims the benefit of U.S. Provisional Applications No. 60/034,643, filed on Jan. 6, 1997 and No. 60/033,274, filed Dec. 9, 1997.

FIELD OF THE INVENTION

This invention is related to lighting assemblies and is more particularly related to fluorescent lighting assemblies using electronic ballasts. Furthermore this invention is related to the connection of one end of each of a pair of fluorescent lamps without direct connection to the ballast.

BACKGROUND OF THE INVENTION

Conventional fluorescent lighting assemblies employ ballasts that are connected to opposite ends of fluorescent lamps. For preheat or rapid-start fluorescent lamps, the ballast is connected in series with the two pins and the filaments at opposite ends of the lamp when the starter switch is closed. When the starter switch is opened the ballast reactor produces a high voltage between filaments at opposite ends of the lamp striking an arc through the argon and mercury vapor in the lamp.

For an instant start fluorescent lamp, no starter switch is used. The circuit is arranged so that a high voltage will be impressed across the lamp when the lamp circuit is closed and the voltage across the lamp is reduced to its normal operating value as soon as conduction takes place and the lamp is started.

In each case the ballast is connected to the bases at both ends of the fluorescent lamp. At least one commercially available instant start ballast is capable of operating multiple lamps in which the ballast is connected only to the pins or electrodes at one lamp end. Interior pins on adjacent lamp bases are commoned. The MULTILITE MUL120 manufactured and sold by Electrofab, Ltd. is capable of energizing an eight foot instant start fluorescent lamp or two four foot instant start fluorescent lamps with adjacent pins on adjacent lamp bases commoned.

For conventional ballasts used in overhead troffers or luminaires, the ballast or ballasts are mounted at the center of the troffer and attached to the top of the troffer. Wires extend from the ballast or ballasts to sockets located at opposite ends of the troffer. For a four lamp assembly, wires must be connected to sockets at both ends of the four lamps. When a defective ballast is replaced, often on a trial and error basis, these wires must be disconnected and reconnected. Installation and maintenance of conventional lighting assemblies is therefor time consuming and cost is added to the manufacturing cost of the lighting assembly.

The commercially available Electrofab MULTILITE MUL120 ballast is housed in a standard ballast case and is also attached in the center of a troffer with wire leads extending from the ballast case to fluorescent lamp sockets at one end of the troffer. This prior art ballast must still be wired in place, and it differs from other conventional ballasts only in that the external electrical wire leads, having a length of up to three feet, are wired just to one end of the lighting fixture. The wiring assembly is therefore no simpler than conventional wiring assemblies in which wires are connected to sockets at opposite ends of the lighting assembly.

One approach to simplifying and therefore reducing the cost of ballast installation is disclosed in U.S. patent application Ser. No. 08/309,300 filed Sep. 20, 1994, now abandoned assigned to The Whitaker Corporation. An integral ballast that can be mounted at one end of a lighting assembly is disclosed in that application. However, a neutral wire must still be connected to the opposite end of the lighting assembly and this wiring must be completed during assembly of the lighting fixture.

SUMMARY OF THE INVENTION

The instant invention eliminates the need to wire both ends of a fluorescent lighting assembly and eliminates the need to wire any ballast to fluorescent lamps. A ballast subassembly that can be employed in a lighting assembly includes a fluorescent ballast circuit contained within a ballast housing that is mounted on one end of a lighting assembly or on one end of a lighting troffer. The ballast subassembly includes two lighting sockets for each pair of fluorescent lamps. The ballast circuit is capable of initially energizing two fluorescent lamps when the ballast circuit is connected to only one end of both fluorescent lamps. The opposite ends of the two lamps forming a single pair are commoned without any direct electrical connection or wire to the ballast. A lighting assembly incorporating this ballast subassembly also includes at least two lamps and a connector, such as a socket connector, at the remote ends of the two fluorescent lamps forming a single pair.

This invention is suited for use with conventional fluorescent lamps and with conventional troffers with only minor modifications, if any. For example, this invention can be employed in a standard four lamp lighting fixture commonly employed in suspended ceilings in office buildings. Commercially available ballast circuits can also be used in the ballast subassembly employed in this invention. The main objective of this invention is to simplify the assembly of lighting fixtures by eliminating the need to connect wires leading from ballasts. Significant manufacturing labor and cost can be eliminated in this manner.

BRIEF DESCRIPTION OF THE DRAWINGS

FIG. 13 is a view of the ballast circuit employed in the electronic ballast used in the preferred embodiment of this invention.

DETAILED DESCRIPTION OF THE PREFERRED EMBODIMENT

Figure 1:
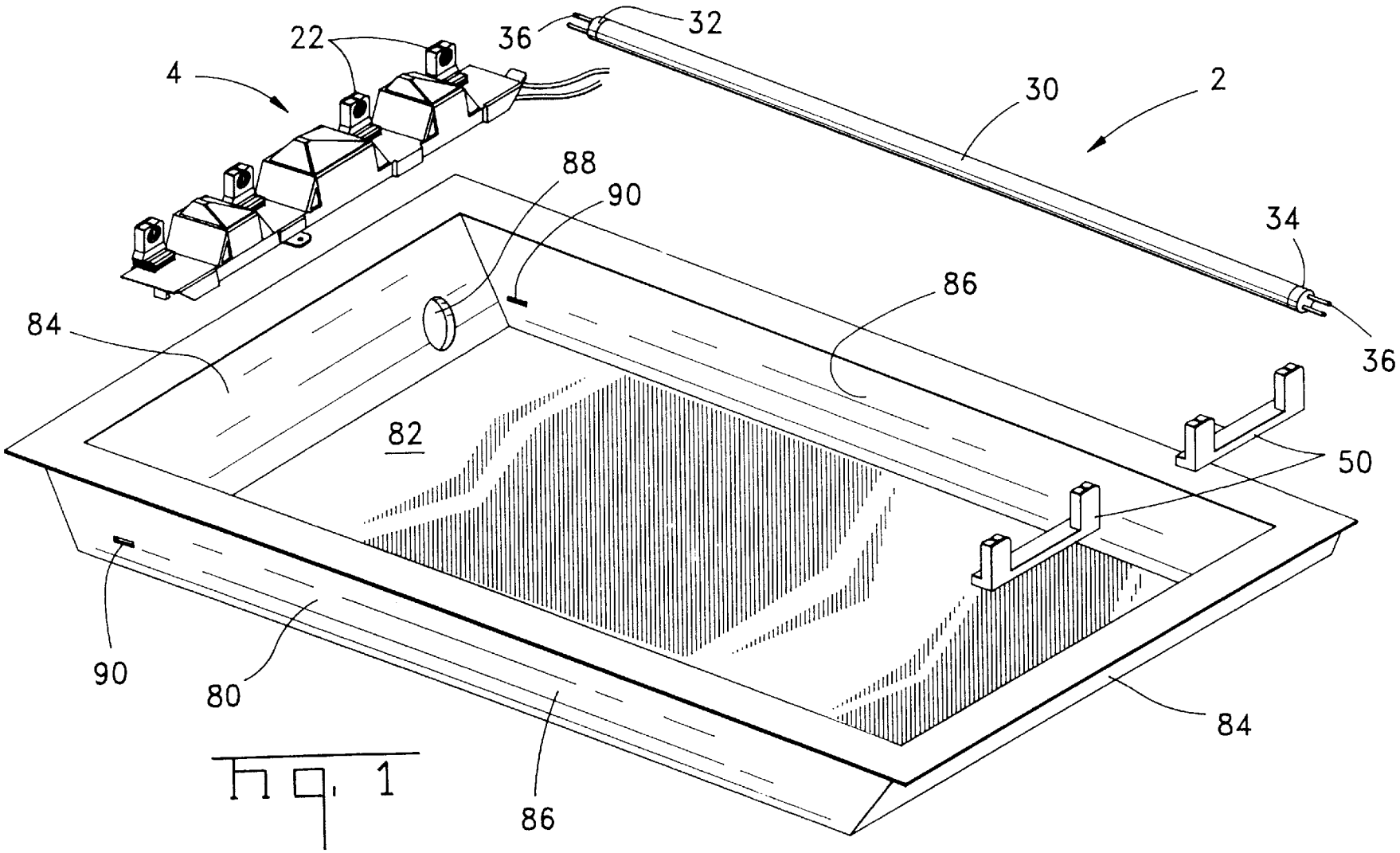
FIG. 1 is an exploded view showing the basic components of the preferred embodiment of a fluorescent lighting assembly that would be used with fluorescent lights in a fluorescent ceiling unit.
Figure 2:
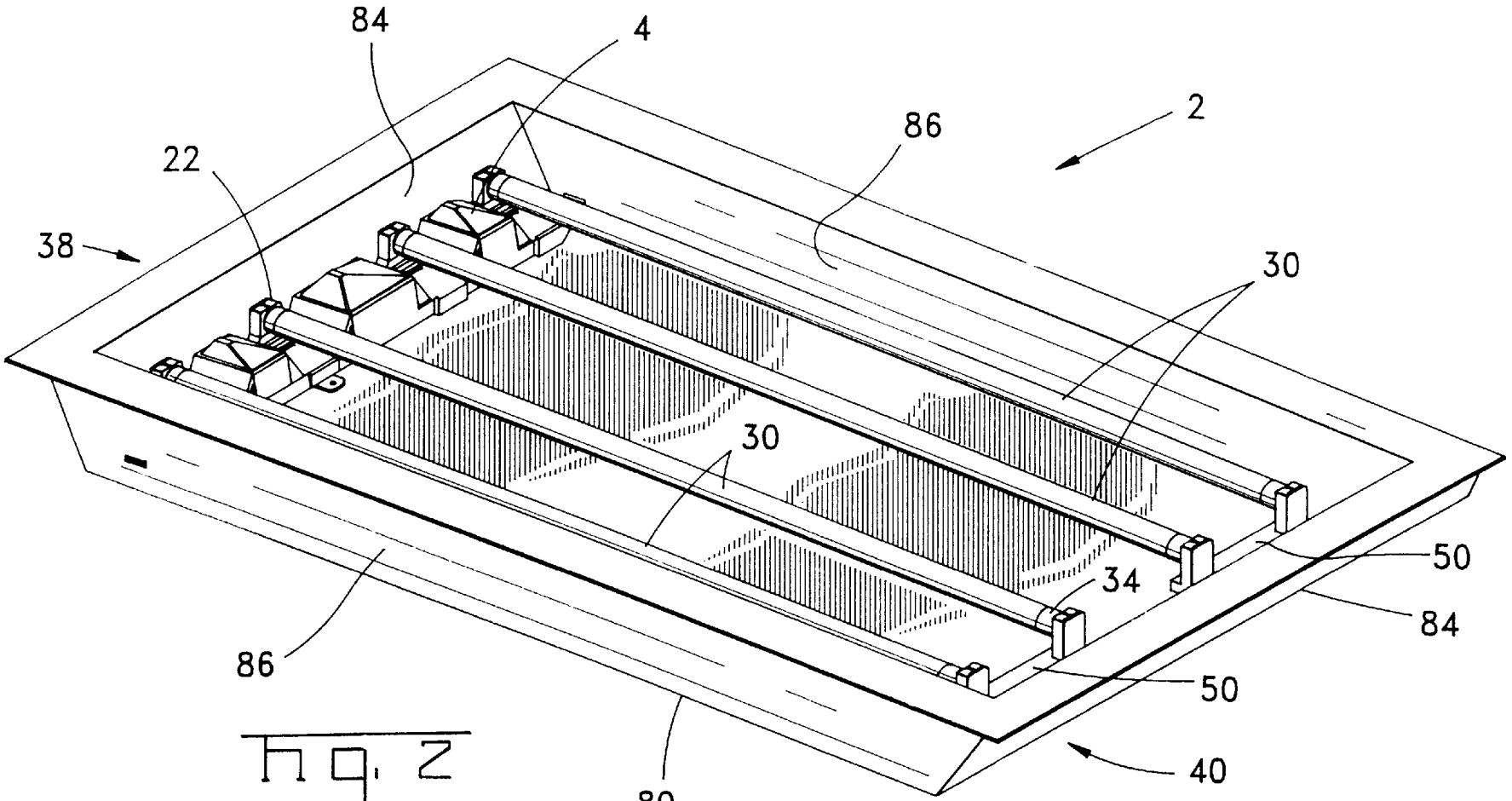
FIG. 2 is a view similar to FIG. 1 showing the position of four fluorescent lamps in relation to the other components of a lighting assembly.

The preferred embodiment of the fluorescent lighting assembly 2 is shown in FIGS. 1 and 2. This lighting assembly includes a ballast subassembly 4 located on a first end 38 of the lighting assembly 2, fluorescent lamps 30 extending between the first end 38 and the second end 40 of the lighting assembly 2, two electrical connectors or lamp sockets 50 located at the second end 40, and a troffer 80 in which the other components are mounted. The preferred embodiment of this lighting assembly is of the type that could be mounted in a suspended ceiling in an office building. The lighting assembly 2 and the troffer 80 are shown in an inverted position in FIGS. 1 and 2 so that the surface of the troffer, facing downward when installed, is visible. This lighting assembly 2 can employ conventional fluorescent lamps 30. In the preferred embodiment the lighting assembly 2 and the ballast subassembly 4 are of the type that would be used with instant start T-8 fluorescent lamps. The ballast subassembly 4 is an electronic ballast of the type that can energize two eight foot fluorescent lamps or four lamps that are four foot in length as in this embodiment.

Figure 3:
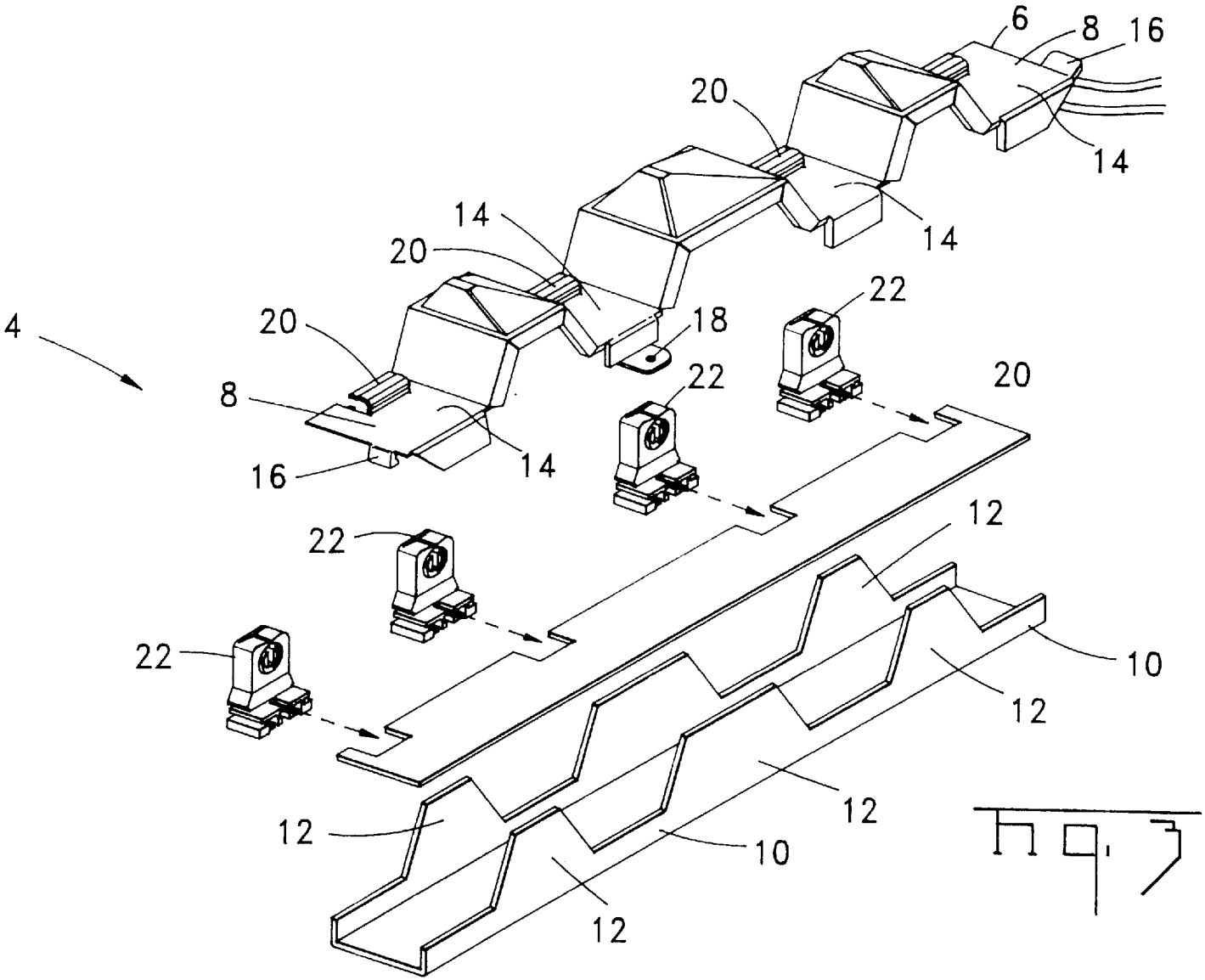
FIG. 3 is an exploded view of an integral lighting ballast hub used in the preferred embodiment of this invention and showing conventional lamp sockets used with the four lamp version of this integral lighting ballast hub.

Ballast subassembly 4, shown in FIG. 3, includes a power supply circuit 100 and a ballast circuit 102 shown in FIGS. 10–12, which will be subsequently described in greater detail. The ballast subassembly 4 is shown in the inverted position in FIG. 3, and references to top and bottom will refer to the orientation in FIG. 3 and not to the orientation when the ballast subassembly is mounted in a ceiling mounted lighting assembly. The electronic components of the circuits forming this ballast subassembly 4 are not shown in detail, but they would be mounted on a printed circuit board 11 that is mounted in the ballast housing 6 in substantially the same manner as the ballast shown in U.S. patent application Ser. No. 08/309,300 filed Sep. 20, 1994 now abandoned and assigned to The Whitaker Corporation. That patent application is incorporated herein by reference. Ballast subassembly 4 is an integral unit or hub and the ballast housing 6 includes a top housing plate 8 attached to a bottom housing plate 10 that encloses the electronic ballast circuitry and the printed circuit board 11 on the interior of the housing 6. Both the top housing plate 8 and the bottom housing plate 10 are fabricated from a sheet metal prepainted on one or both sides or dry powder coated on one or both sides with a typical thickness from 20 to 32 mils. Ballast housing 6 includes three protruding housing sections 12 that provide room for the larger components in the power supply circuit and the ballast circuit of the electronic ballast. Four channels 14 are located on the top of the ballast subassembly 4 as shown in FIG. 3 and extend between and on either side of the protruding housing sections 12. Channels 14 provide space for mounting fluorescent lamps 30 and conventional fluorescent sockets 22. Socket clips 20 extend from the housing top plate 8 in each channel 14. These socket clips 20 are configured to attach conventional fluorescent lamp sockets 22 in each channel to engage pins on the first base of a fluorescent lamp 30. Mounting tabs 16 are located at opposite ends of the ballast housing 6. These mounting tabs are received within slots 90 on the troffer 80 to attach the ballast subassembly 4 to a first end of the troffer and of the lighting assembly 2. Ballast housing 6 also includes a grounding tab 18 that can be screwed to the troffer 80 to provide a safety ground. Wire leads extend from one end of the ballast subassembly 4 in a position where they can extend through a suitable opening 88 in the troffer 80 for connection to an external source of electrical power, such as a conventional source of 120 VAC or 277 VAC power commonly used in lighting circuits. As shown in FIGS. 1 and 2, the ballast subassembly 4 is mounted on only one end of the lighting assembly 2 and the troffer 80 with no wires or external conductors extending from the ballast assembly 4, with the exception of the connection to an external source of electrical power.

Fluorescent lamps 30 are conventional tubular fluorescent lamps with a first bipin base 32 at one end and a second bipin base 34 at the opposite end. The two pins 36 at opposite ends are conventional. Fluorescent lamps 30 are instant start lamps with a conventional instant start electrode (not shown) connected to pins 36 at each end of the glass envelope forming the lamp 30. In the preferred embodiment the fluorescent lamps 30 are used with a suitable instant start electronic ballast circuit and power supply circuit such as that used in the MULTILITE MUL120 manufactured and sold by Electrofab, Ltd.

The pins 36 fit with conventional fluorescent sockets 22 of the type employed on the ballast subassembly 4. The lamps 30 can be rolled into position in the sockets in a conventional manner. Since the preferred embodiment of this invention employs instant start fluorescent lamps, it should be understood that instant start fluorescent lamps having a single pin on each base could also be employed with suitable sockets. This invention could also be employed with preheat, rapid start, or hot cathode fluorescent lamps and a suitable preheat, rapid start or hot cathode electronic ballast.

In this invention, only the first base 32 of each fluorescent lamp 30 is connected directly to the electronic ballast in ballast subassembly 4. The opposite second base 34 and the pins 36 therein are connected to an electrical connector or socket subassembly 50. This invention is intended to be used with multiple fluorescent lamps 30, and in the preferred embodiment of this invention, the fluorescent lamps are paired so that for each pair of fluorescent lamps the respective first base 32 is attached to the ballast and the respective second bases 34 of the two lamps in each pair are electrically commoned by the electrical connector or socket subassembly 50. In the preferred embodiment of FIGS. 1–8 both pins in the second bases 34 of the two lamps in each pair of lamps are connected to the corresponding pin 36 in the other lamp. Separate connections are established for each pin and all four pins on the second bases 34 at the second end 40 of the lighting assembly 2 are not commoned. It should be understood, however, that for instant start fluorescent lamps, all four pins could be commoned and for this it would only be necessary to connect one pin 36 in each second base of the two fluorescent lamps 30. However, to insure reliable operation, each pin on a bipin lamp would be connected to the corresponding pin on the other lamp for redundancy and to prevent uneven wear on the lamps and premature failure. For this invention only the first bases 32 at the first end 38 of the lighting assembly will be energized to start the lamps. No current will flow through the pins 36 in the second bases 34 of the fluorescent lamp pairs until an arc is established between the opposite ends of each lamp 30. By using an electronic ballast, such a the MULTILITE MUL120 manufactured and sold by Electrofab, Ltd., that is capable of operating fluorescent lamps of twice the length of the lamps 30, it then becomes possible simply to common the second bases in this manner. The electronic ballast used in ballast subassembly 4 is also capable of operating two separate pairs of fluorescent lamps, so the preferred embodiment employs two pairs or four lamps 30. Although the preferred embodiment is used with pairs of lamps, it should be understood that more than two lamps could be commoned end-to-end in this manner so long as the electronic ballast was capable of operating lamps having the total length. For example, three curved lamps or four straight lamps could be commoned in this manner so long as the end lamp returned to the same ballast subassembly. This invention can also be used with U-shaped lamps.

Figures 4, 8:
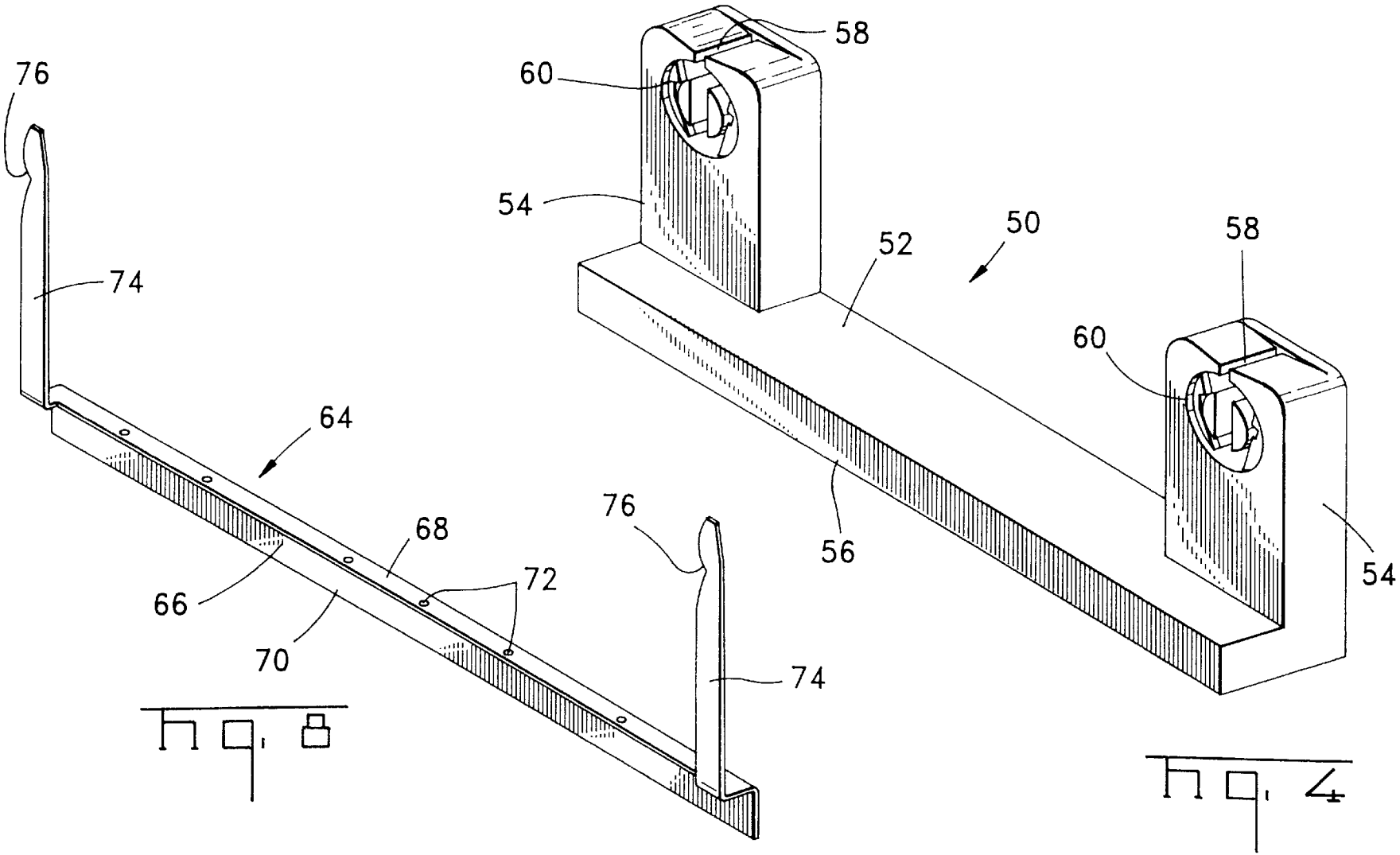
FIG. 4 is a perspective view of a lamp socket subassembly employed for commoning the remote ends of a pair of fluorescent lamps.
FIG. 8 is a perspective view of one commoning contact used in the lamp socket subassembly of FIGS. 4–7.
Figure 5:
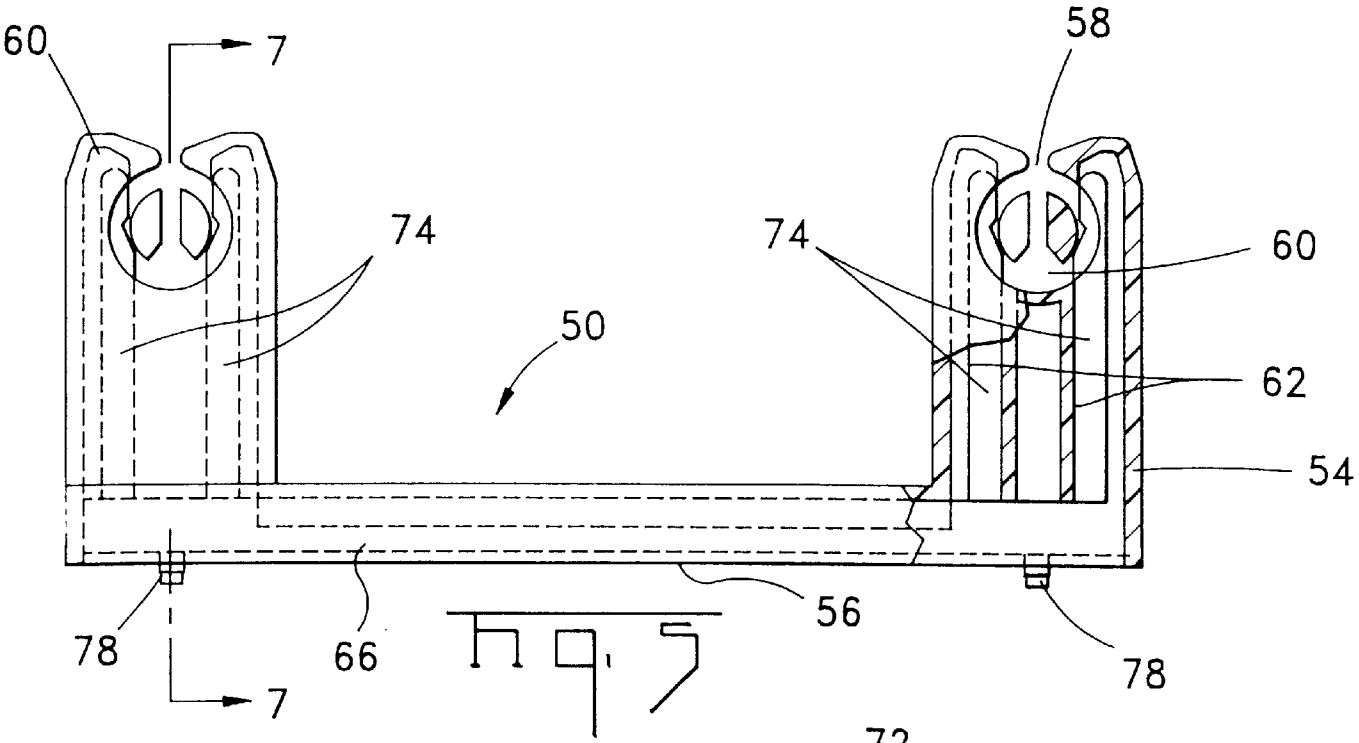
FIG. 5 is a front view, partially in section, of the lamp socket subassembly shown in FIG. 4.
Figure 6:
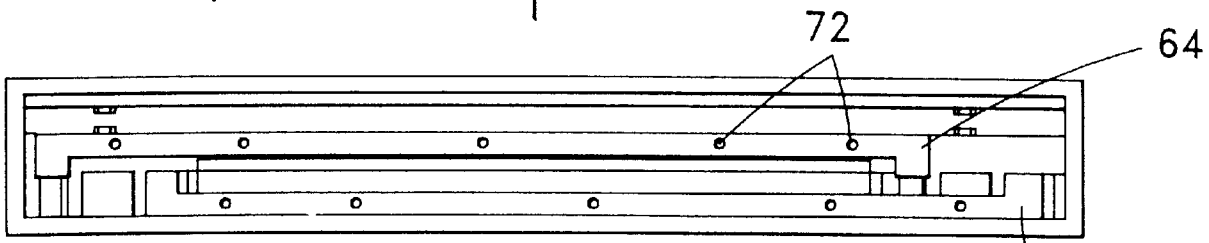
FIG. 6 is a bottom view of the lamp socket subassembly shown in FIGS. 4 and 5, showing two commoning bus bars.
Figure 7:
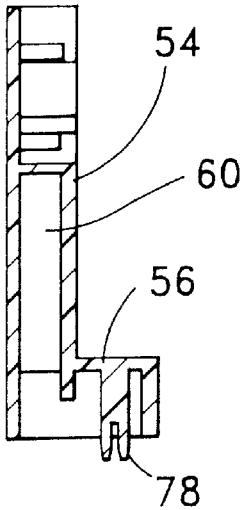
FIG. 7 is a section view taken through Section Lines 7—7 in FIG. 5.

In the preferred embodiment of FIGS. 1–8, each electrical connector or socket subassembly 50 includes a socket housing 52 formed of a suitable insulative material and two separate electrical contacts 64 mounted in the housing 52. A separate socket connector subassembly 50 is used with each pair of lamps 30. As shown in FIG. 4, the socket housing 52 is a one-piece member having two upright arms 54 extending from opposite ends of a central bus housing section 56. Each housing arm 54 has substantially the same configuration as a conventional fluorescent socket 22. A single pin channel 58 extends into the top inside surface of each arm and this single pin channel 58 is bifurcated and becomes bifurcated circular grooves 60 having the same construction as in conventional sockets 22. These grooves permit a bipin base of a fluorescent lamp to be inserted first with the pins in line and then rolled in a conventional manner until the pins 36 on a fluorescent lamp 30 are fully seated.

Socket housing 52 includes contact slots extending upwardly from the bus section 56 into both socket arms so two separate commoning contacts 64 can be inserted through the bottom of the housing 52 into position. A single contact 64 is shown in FIG. 8. Each contact 64 is stamped and formed from an electrically conductive material, such as brass. Contact 64 has a bus section 66 joining two socket terminals 74 in the form of cantilever arms extending upwardly from opposite ends of the bus section 66. The bus section 66 has an L-shaped cross section with a horizontal surface 68 joined to a vertical surface 70 that extends to the bottom of the contact 64. A plurality of holes 72 are stamped in the horizontal section so that the commoning contact 64 can be heat staked or ultrasonically staked to the housing 52 after the two contacts 64 are inserted into contact slots 62 into the positions shown in FIGS. 5 and 6. The bus bar could also be snapped into the housing or mounted in the housing in a number of conventional ways.

Cantilever arm terminals 74 extend upward into the slots in the housing arms 54. When fully inserted the tops of the terminals are positioned adjacent to the socket grooves 60. The inner edge of each terminal includes a notch 76 configured to engage one of the pins 36 on a second base 34 of a bipin fluorescent lamp 30. The contact 64 commons corresponding pins on a pair of fluorescent lamps 30. For example, a contact 64 oriented as shown in FIG. 8 would common the right pins on two parallel fluorescent lamps 30. If the contact 64 were rotated one hundred eighty degrees about a vertical axis, so that the contact notches 76 face to the right, instead of to the left as in FIG. 8, the contact 64 would common the left hand pins in two parallel fluorescent lamps. In other words, two identical contacts 64 could be used in the same socket connector 50 to connect respective pins in two side by side fluorescent lamps in parallel. To form this parallel connection, the two commoning contacts 64 would be offset as shown in the bottom view of FIG. 6.

The two commoning contacts 64 and the electrical socket connector 50 only common the contacts in the second base 34 of two side by side fluorescent lamps 30. There is no direct connection or wire extending from the ballast subassembly 4 to the socket connector 50 and the commoning contacts 64 will only carry current after an arc is established between the first base 32 and the second base 34 of each of the two side by side fluorescent lamps 30 forming one pair. The connection of the second bases 34 does not function to initially energize either fluorescent lamp. In this embodiment, two separate socket connectors 50 are used for the two pairs of fluorescent lamps 30 used in this four lamp lighting fixture 2. Each socket connector 50 includes mounting posts 78 that are part of an integrally molded insulative housing. These mounting posts can be inserted into holes in the troffer to mount the connectors 50 adjacent the second end 40 of the lighting assembly 2. It should be understood that the commoning contacts 64 could however be located in a single housing.

The integral ballast subassembly 4 and the connector sockets 50 can be mounted on troffer 80 as shown in FIGS. 1 and 2. Troffer 80 is generally conventional in construction having a top wall 82, two end walls 84 at the first and second ends of the lighting assembly and two side walls. As shown in FIG. 2, the four fluorescent lamps 30 can be mounted in this troffer 80 on substantially equally spaced centerlines without the need for additional space between the two center fluorescent lamps for mounting conventional ballasts. Troffer 80 also includes slots 90 for receiving the mounting tabs 16 on the ballast subassembly. The troffer 80 also has an access opening 88 though which wires from the ballast subassembly exit for connection of a source of 120 VAC electrical power. A screw hole (not shown) for the grounding screw could also be provided as well as mounting holes for receiving the plastic mounting posts 78 on the connector sockets 50.

Both the ballast subassembly 4 and the socket connectors 50 are mounted to the troffer 80 without interconnecting wires or external conductors. It is not necessary to wire the integral ballast subassembly 4 to lamp sockets on either end of the lighting assembly. The two socket connectors 50 are not joined by any wires or conductors and neither socket connector 50 is connected to any ballast or directly to any source of electrical current or to any voltage source. The only wires in the lighting assembly are the wires connecting the integral ballast subassembly 4 to a source of electrical power, such as a 120 VAC or a 277 VAC branch or power source commonly used in lighting applications.

Figure 9:
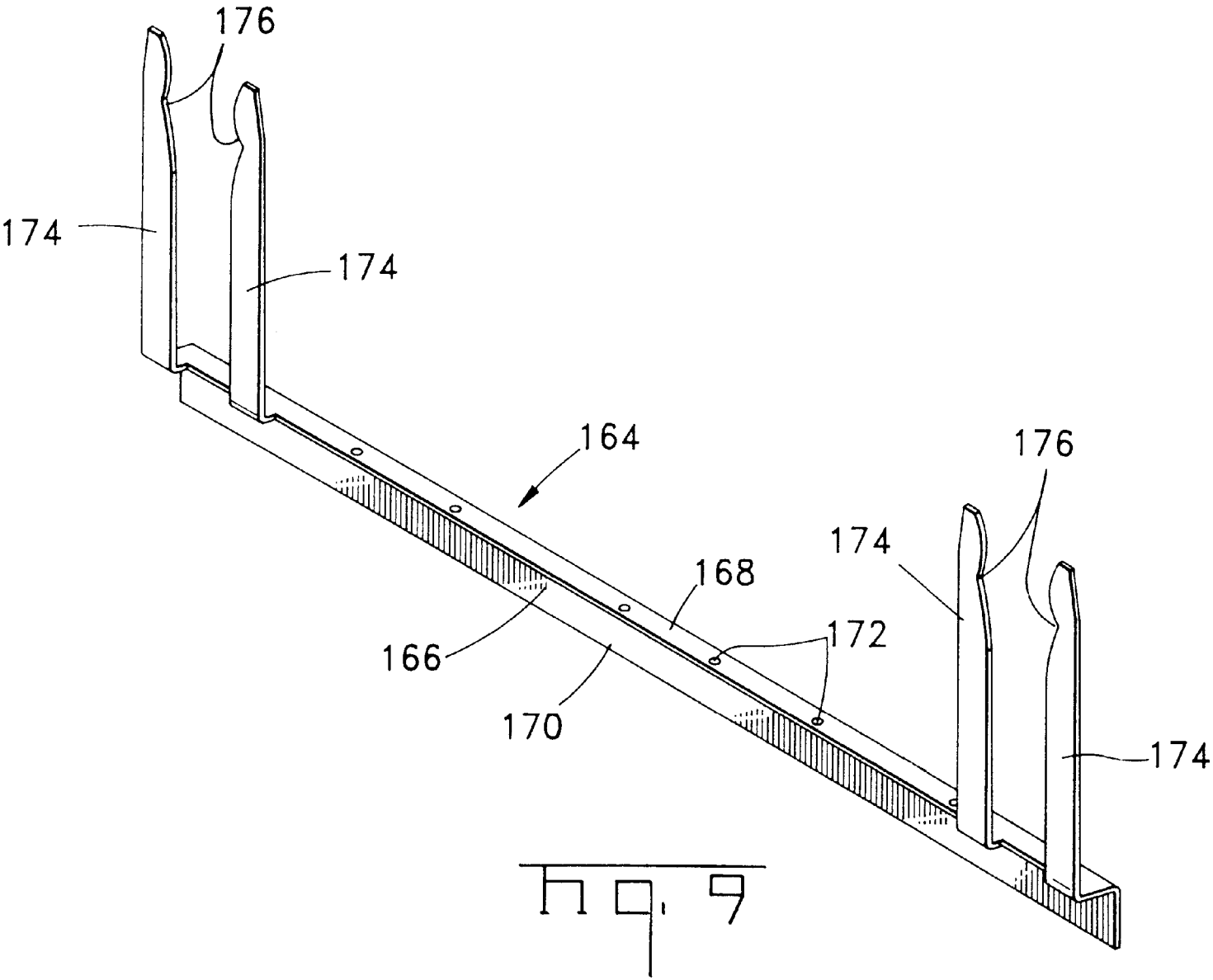
FIG. 9 is a view of an alternate embodiment of the lamp socket of FIGS. 4–8 in which a single bus bar commons the four pins of two bipin fluorescent lamps.

FIG. 9 shows an alternate embodiment of an electrical contact 164 that can be employed in a socket connector of the same general type as socket connector 50. Only one contact 164 would be necessary to connect the second ends of two fluorescent lamps. Contact 164 has two cantilever socket terminal arms 174 at each end. Each terminal arm 174 makes contact with one of the two pins on the corresponding lamp with inwardly facing notches 176 engaging the cylindrical contact pins on the lamps. Redundant contact is thus established between the two lamps and uneven wear of the lamps would be avoided.

Figure 10:
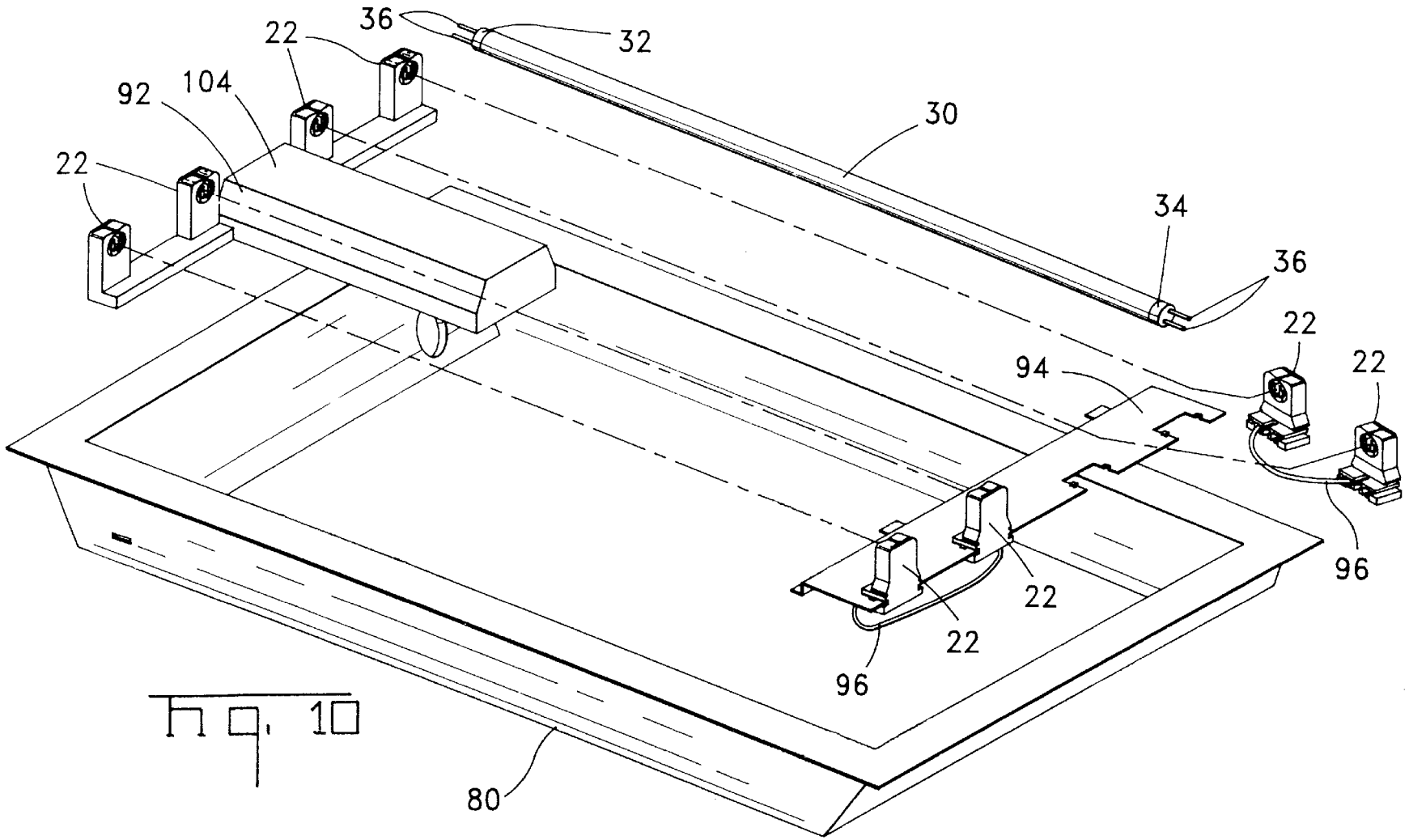
FIG. 10 is an exploded perspective view of an alternate embodiment of this invention.

One alternate embodiment of this invention is shown in FIG. 10. This alternate embodiment differs from the preferred embodiment in three respects. First the integral ballast subassembly 104 has a different shape. This alternate ballast subassembly is shaped so that bulky portions can be positioned in the center of the troffer in a portion of the space where conventional ballasts would otherwise be located. Thus the fluorescent lamps would not be equally spaced and would be located in substantially the same position as in conventional fixtures. A second difference is that conventional sockets 22 are used with a conventional sheet metal mounting bracket 94 to connect fluorescent lamps in each pair instead of the socket connectors 50 used in the preferred embodiment. Sockets 22 in the same pair are wired together by wires 96 to connect pins 36 on the second bases of corresponding fluorescent lamps 30 instead of being wired to conventional ballasts in a conventional lighting assembly. Sockets 22 adjacent the second end of the lighting assembly in FIG. 10 are not wired to the ballasts. The third difference is that only a single wire 96 connects two corresponding sockets. Only a single terminal is used in each of the sockets 22 on the right of the lighting assembly in FIG. 10, because only one current path is necessary to common the two bipin second bases 34 of the two fluorescent lamps in the same pair. This is analogous to the use of only one contact 64 in the embodiment of FIGS. 1 and 2. A jumper wire could also be added between the two contacts in each socket 22 with only a single wire 96 joining the two corresponding sockets.

Figure 11:
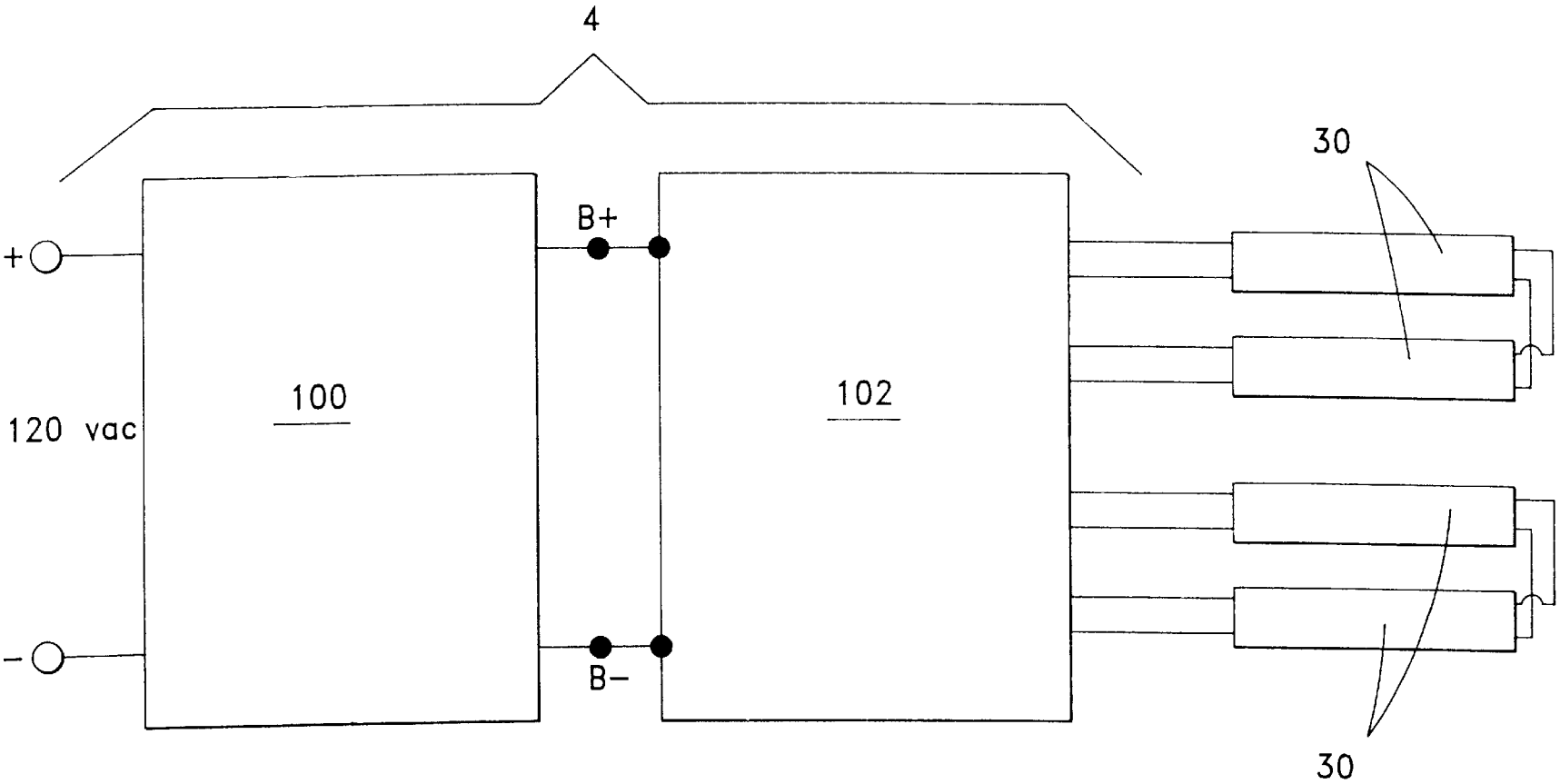
FIG. 11 is a block diagram of the components of the ballast circuitry employed in the preferred embodiment showing the manner in which four fluorescent lamps can be connected to this electronic ballast.
Figure 12:
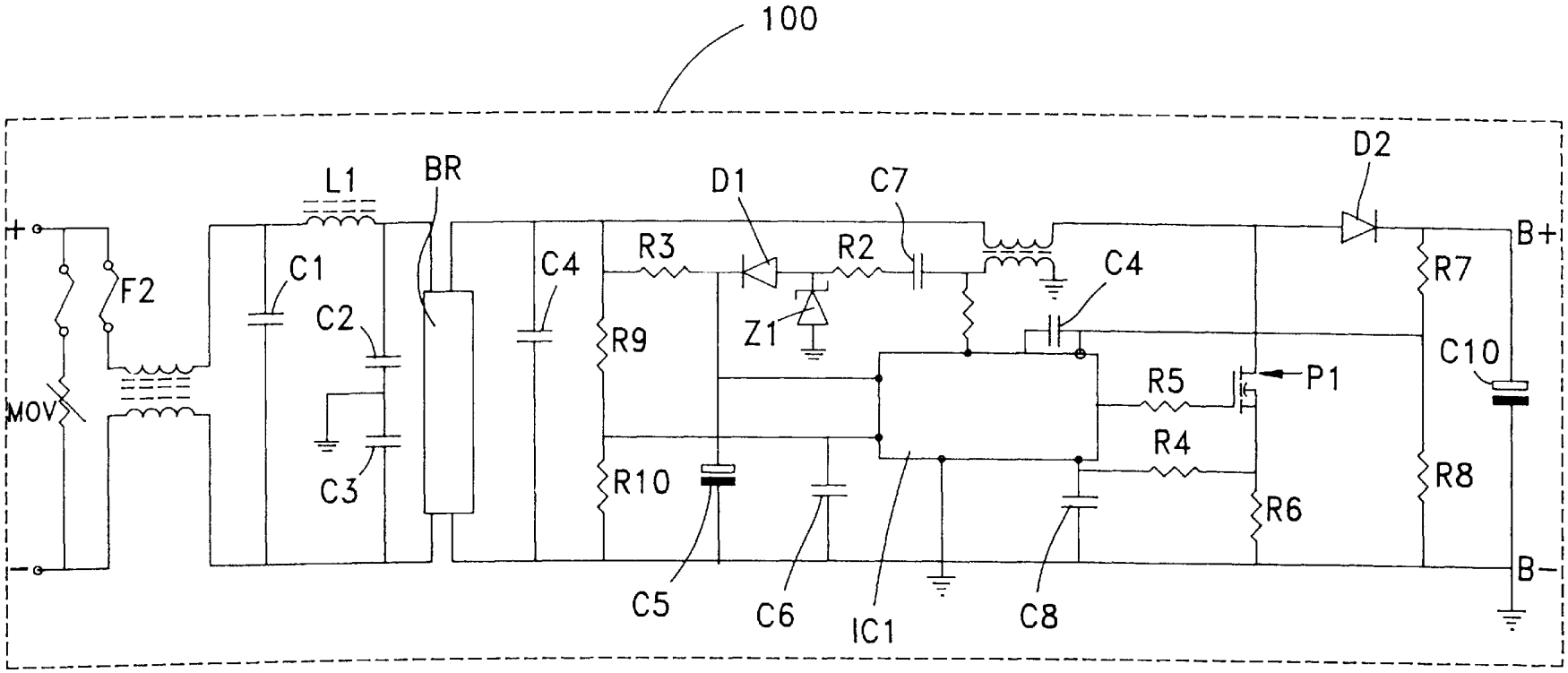
FIG. 12 is a schematic of a power supply circuit employed in the electronic ballast employed in the preferred embodiment of this invention.
Figure 17:
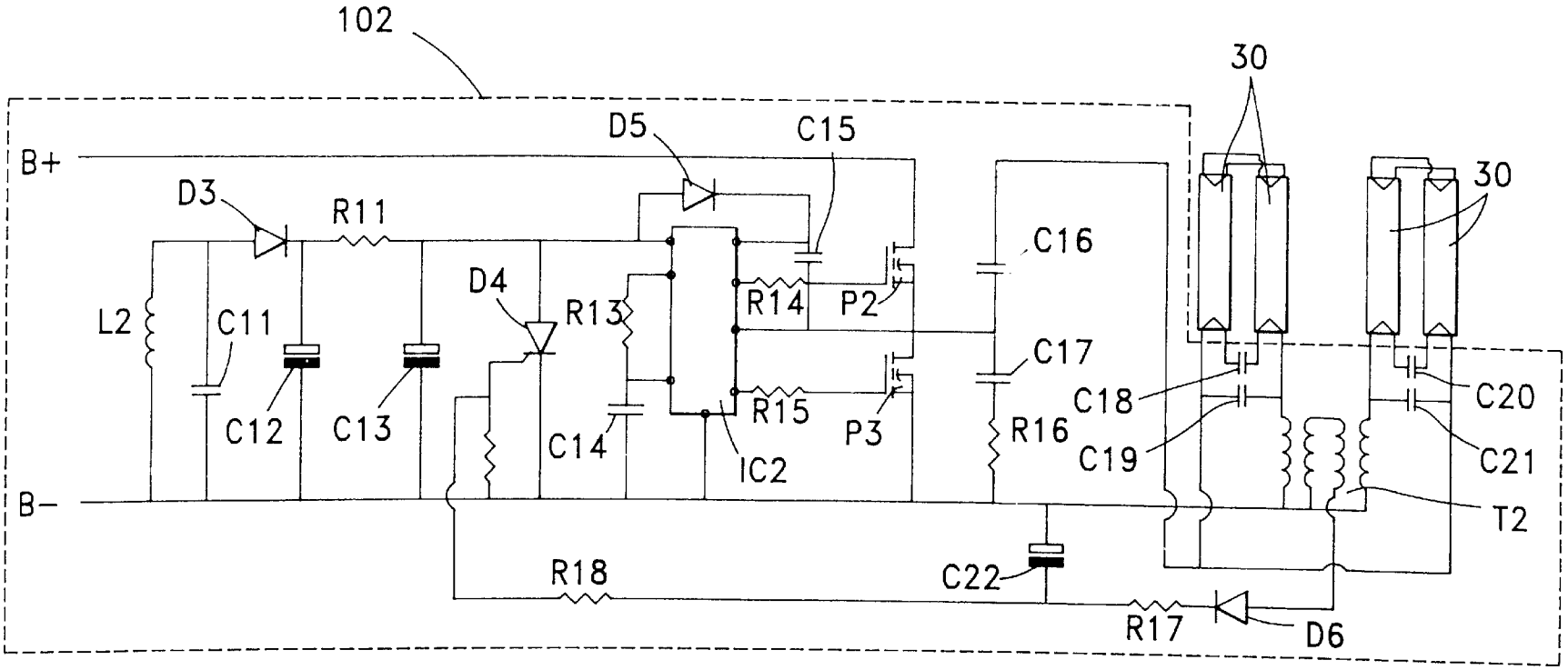

The electronic ballast and the power supply circuit 100 and ballast circuit 102 used in the two representative embodiments of this invention are shown in FIGS. 11–13. This electronic ballast is commercially available and is manufactured and sold as the MULTILITE MUL120 ballast by Electrofab, Ltd. This ballast is capable of operating two eight-foot instant start fluorescent lamps or four lamps in two pairs. Component values and component designations are listed in the following table.

ELECTRONIC BALLAST COMPONENTS

C1 250 V
C2 5000 pF 2 KV
C3 5000 pF 2 KV
C4 1☞F 250V
C5 22☞F 25V
C6 10 nF
C7 10 nF
C8 1 nF
C9 330 nF
C10 150☞F 385V
C11 5000 pF
C12 22☞F 63V
C13 47☞F 25V
C14 0.001☞F
C15 0.1☞F
C16 1☞F 400V
C17 0.001☞F 600V
C18 1 nF
C19 5.6 nF
C20 5.6 nF 1000V
C21 1 nF
C22 100☞F 50V
R1 68 KOHMS
R2 100 OHMS
R3 68 KOHMS
R4 330 OHMS
R5 10 OHMS
R6 0.33 OHMS 1 W
R7 1.5 MOHMS 1%
R8 5.76 KOHMS
R9 1.5 MOHMS 1%
R10 15 KOHMS 1%
R11 1.3 KOHMS
R12 330 OHMS
R13 22 KOHMS
R14 22 OHMS
R15 22 OHMS
R16 10 OHMS
R17 220 OHMS
R18 4.7 KOHMS
D1 1N4148
D2 31KF4
D3 MUR 130
D4 S2261
D5 11DF4
Z1 1N52488
BR BRIDGE RECTIFIER KBL10
IC1 SGS-THOMSON L6560
IC2 INTERNATIONAL RECTIFIER IR1251

The representative embodiments of this invention depicted herein show the various elements of this invention and their essential relationship. It should, however, be understood that these embodiments are only representative and that numerous alternatives, still within the scope of this invention, would be apparent to one of ordinary skill in the art. For example, the commoning connectors employed herein are only representative of numerous alternatives. For example, this invention could be employed in a lighting assembly employing lamps with a single pin and with corresponding lamp holders such as conventional plunger end or stationary end lampholders used with slimline lamps. The use of this lighting assembly is also not limited to use with troffers used in suspended ceilings. This lighting fixture could be used with other conventional luminaires such as conventional closed end or open end luminaires. Although one of the advantages of this invention is that it can be used with conventional fluorescent lamps, such as T-8 fluorescent lamps, the invention could also be adapted for use with nonconventional lamps. Therefore the invention is defined in terms of the following claims and is not limited to the specific representative embodiments depicted and described herein.

We claim:

1. A ballast subassembly for use in a fluorescent lighting assembly, the ballast subassembly comprising:

a fluorescent ballast circuit contained within a ballast housing, the ballast housing being configured for mounting on only one end of a fluorescent lighting troffer, the ballast subassembly including at least one pair of fluorescent sockets, the ballast circuit being capable of initially energizing two fluorescent lamps when the ballast circuit is connected only to a single end of each fluorescent lamp received within the two sockets in the ballast subassembly with opposite ends of the two fluorescent lamps being electrically commoned without connection to the ballast circuit, whereby the ballast subassembly can be mounted in a fluorescent lighting troffer without external conductors extending between opposite ends of the fluorescent lighting troffer.

2. The ballast subassembly of claim 1 wherein the ballast subassembly includes two pairs of sockets, the ballast circuit being capable of initially energizing two pairs of fluorescent lamps.

3. The ballast subassembly of claim 2 wherein the ballast subassembly comprises an instant start fluorescent ballast subassembly.

4. The ballast subassembly of claim 3 wherein the ballast subassembly includes a ballast circuit capable of energizing four instant start fluorescent lamps, each having a length of four feet.

5. The ballast subassembly of claim 1 wherein the ballast circuit comprises an electronic ballast circuit.

6. The ballast subassembly of claim 1 wherein the ballast subassembly includes a power supply circuit connectable to a source of electrical power.

7. A fluorescent lighting assembly comprising:

a ballast subassembly including a circuit including a ballast, the circuit being connectable to a source of electrical power and at least one pair of fluorescent sockets;

at least one pair of fluorescent lamps, each lamp having a first base and a second base, the first and second base of each lamp including at least one pin, at least one pin on the first base of each lamp being connected to a socket in the ballast subassembly so that the ballast energizes the fluorescent lamp at the first base; and an electrical connector connecting at least one pin on the second bases of the two lamps forming each pair, so that the second end of each lamp of each pair is only connected to the second end of the other lamp of each pair.

8. The lighting assembly of claim 7 wherein the ballast comprises a ballast capable of energizing two instant start fluorescent lamps when connected to only one end of each lamp.

9. The lighting assembly of claim 7 wherein the ballast comprises an electronic ballast.

10. The lighting assembly of claim 7 wherein the ballast subassembly and the electrical connector are independently mounted at opposite ends of a troffer.

11. A fluorescent lighting assembly comprising:

at least one pair of fluorescent lamps, each lamp having a first base and an opposite second base, the first base of each lamp being located adjacent a first end of the lighting assembly and the second base of each lamp being located adjacent a second end of the lighting assembly;

a ballast subassembly located adjacent only the first end of the lighting assembly, the ballast subassembly including a ballast and fluorescent sockets mounted thereon for connection to the first base of each lamp to supply electrical energy for starting the two lamps of each pair; and an electrical connection between the second bases of the two lamps of each pair, the electrical connection extending only between the second bases of the lamps of each pair;

whereby the ballast need not be connected to the second bases of the lamps located adjacent the second end of the fluorescent lighting assembly.

12. The lighting assembly of claim 11 wherein the lamps and the ballast are instant start fluorescent lamps and ballasts.

13. The lighting assembly of claim 11 wherein the ballast subassembly includes lamp sockets as part of an integral ballast subassembly.

14. The lighting assembly of claim 11 wherein the only non-grounded electrical path connecting opposite ends of the lamps is through the fluorescent lamps.

15. The lighting assembly of claim 11 wherein the electrical connection between the second bases of a pair of lamps comprises two fluorescent sockets, each socket including at least one terminal, each terminal in each socket being electrically connected to a terminal in the other socket.

16. The lighting assembly of claim 15 wherein each terminal comprises a section of a bus extending between the two sockets.

17. The lighting assembly of claim 16 wherein the bus and the terminal comprises sections of a stamped and formed one piece member, each terminal comprising a cantilever arm extending from an end of an intermediate bus section.

18. The lighting assembly of claim 11 wherein the electrical connection comprises a socket subassembly, the socket subassembly comprising an insulating housing, the housing including spaced housing sections configured to receive a fluorescent lamp base, the socket subassembly also including at least one electrical contact member including a bus section and two spaced terminal sections configured to electrically engage a fluorescent lamp base received in a corresponding housing section in which the terminal section is located.

19. The lighting assembly of claim 18 wherein two contact members are included in the socket subassembly.

20. The lighting assembly of claim 11 further comprising a troffer, the ballast and the electrical connection being mounted to the troffer at opposite ends of the troffer, with the fluorescent lamps being attached to the ballast and to the electrical connection without any external electrical conductors extending to the electrical connection.

* * * * *